US010770209B2

(12) United States Patent
Nanbara et al.

(10) Patent No.: US 10,770,209 B2
(45) Date of Patent: Sep. 8, 2020

(54) SOFT MAGNETIC POWDER, MAGNETIC CORE, METHOD FOR MANUFACTURING SOFT MAGNETIC POWDER, AND METHOD FOR MANUFACTURING MAGNETIC CORE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Shintaro Nanbara, Mie (JP); Kazushi Kusawake, Mie (JP); Takashi Takada, Mie (JP)

(73) Assignees: AutoNetworks Technologies, Ltd., Yokkaichi, Mie (JP); Sumitomo Wiring Systems, Ltd., Yokkaichi, Mie (JP); Sumitomo Electric Industries, Ltd., Osaka-Shi, Osaka (JP)

( * ) Notice: Subject to any disclaimer, the term of this patent is extended or adjusted under 35 U.S.C. 154(b) by 112 days.

(21) Appl. No.: 15/772,912

(22) PCT Filed: Nov. 9, 2016

(86) PCT No.: PCT/JP2016/083205
§ 371 (c)(1),
(2) Date: May 2, 2018

(87) PCT Pub. No.: WO2017/090430
PCT Pub. Date: Jun. 1, 2017

(65) Prior Publication Data

US 2018/0315528 A1 Nov. 1, 2018

(30) Foreign Application Priority Data

Nov. 27, 2015 (JP) ..... 2015-231760

(51) Int. Cl.
*H01F 1/147* (2006.01)
*B22F 1/02* (2006.01)
(Continued)

(52) U.S. Cl.
CPC ..... *H01F 1/14766* (2013.01); *B22F 1/0085* (2013.01); *B22F 1/02* (2013.01);
(Continued)

(58) Field of Classification Search
CPC ..... B22F 1/0062; B22F 1/02; C23C 22/07; C23C 22/08; C23C 22/23
See application file for complete search history.

(56) References Cited

U.S. PATENT DOCUMENTS

2010/0045120 A1* 2/2010 Kitano ..... B22F 1/0062 310/44
2011/0068506 A1 3/2011 Kusawake et al.
(Continued)

FOREIGN PATENT DOCUMENTS

JP 2006-024869 A 1/2006
JP 2009-302359 A 12/2009
JP 2013-243268 A 12/2013

OTHER PUBLICATIONS

Search Report for PCT/JP2016/083205, dated Feb. 7, 2017.

*Primary Examiner* — Alexandre F Ferre
(74) *Attorney, Agent, or Firm* — Honigman LLP

(57) ABSTRACT

Provided is soft magnetic powder constituted by an Fe alloy containing Si, in which soft magnetic particles of the soft magnetic powder include a $SiO_2$ layer formed on a surface of the particles, and a surface layer formed directly on the $SiO_2$ layer. The surface layer includes a first material that constitutes a matrix and a second material that is dispersed
(Continued)

in the matrix. The first material is silicone or phosphate, and the second material is silicone or phosphate and is different from the first material.

12 Claims, 2 Drawing Sheets

(51) Int. Cl.

| | |
|---|---|
| ***B22F 1/00*** | (2006.01) |
| ***C22C 38/02*** | (2006.01) |
| ***H01F 41/02*** | (2006.01) |
| ***H01F 27/255*** | (2006.01) |
| ***C22C 38/00*** | (2006.01) |
| ***C22C 33/02*** | (2006.01) |
| ***H01F 3/08*** | (2006.01) |
| ***H01F 1/26*** | (2006.01) |
| *H01F 37/00* | (2006.01) |
| *B22F 3/02* | (2006.01) |

(52) U.S. Cl.
CPC ..... *C22C 33/0278* (2013.01); *C22C 38/00* (2013.01); *C22C 38/02* (2013.01); *H01F 1/26* (2013.01); *H01F 3/08* (2013.01); *H01F 41/0246* (2013.01); *B22F 3/02* (2013.01); *B22F 2301/35* (2013.01); *B22F 2998/10* (2013.01); *C22C 2202/02* (2013.01); *H01F 27/255* (2013.01); *H01F 37/00* (2013.01)

(56) References Cited

U.S. PATENT DOCUMENTS

| | | | | |
|---|---|---|---|---|
| 2012/0154083 | A1 | 6/2012 | Ohwaki et al. | |
| 2013/0056674 | A1* | 3/2013 | Inagaki ..... | B22F 1/007 252/62.55 |
| 2015/0228387 | A1 | 8/2015 | Urushihara et al. | |

* cited by examiner

SOFT MAGNETIC POWDER, MAGNETIC CORE, METHOD FOR MANUFACTURING SOFT MAGNETIC POWDER, AND METHOD FOR MANUFACTURING MAGNETIC CORE

CROSS-REFERENCE TO RELATED APPLICATIONS

This application is the U.S. national stage of PCT/JP2016/083205 filed Nov. 9, 2016, which claims priority of Japanese Patent Application No. JP 2015-231760 filed Nov. 27, 2015.

TECHNICAL FIELD

The present invention relates to soft magnetic powder, a magnetic core, a method for manufacturing soft magnetic powder, and a method for manufacturing a magnetic core.

BACKGROUND

A magnetic core constituted by a composite material obtained by molding a mixture of soft magnetic powder and resin and solidifying the resin is known as a magnetic core (for example, see JP 2008-147403A, JP 2012-212855A and JP 2012-212856A). The composite material constituting the magnetic core is advantageous in that the relative magnetic permeability is easily adjusted by adjusting the amount of soft magnetic powder with respect to the resin. Thus, the magnetic core constituted by the composite material is expected to be used in a wide range of applications.

If Fe-based soft magnetic powder is used as the soft magnetic powder, an insulating layer is formed on a surface of soft magnetic particles in order to ensure the insulation between the soft magnetic particles in the composite material. Examples of the insulating layer include a phosphate layer and a silicone layer.

In recent years, because of a growing interest in effective use of energy, there has been demand for a magnetic core constituted by a composite material having superior magnetic properties compared to a conventional composite material. An example of a magnetic property required for the magnetic core includes good direct current superimposition characteristics, that is, constant magnetic permeability according to which the relative magnetic permeability is unlikely to change whether in a low magnetic field or a high magnetic field. Also, an example of a magnetic property required for the magnetic core is low energy loss (specifically, iron loss). Also, the magnetic core used in a reactor of a hybrid car or the like is exposed to strong vibration, and thus needs to have excellent mechanical strength.

SUMMARY

An object of this disclosure is to provide soft magnetic powder with which a magnetic core having excellent magnetic properties and mechanical strength can be produced, and a method for manufacturing the soft magnetic powder. Also, an object of this disclosure is to provide a magnetic core having excellent magnetic properties and mechanical strength, and a method for manufacturing the magnetic core.

Effects of Disclosure

When the soft magnetic powder of this disclosure is used in a magnetic core, it is possible to obtain a magnetic core having excellent magnetic properties and mechanical strength.

The magnetic core of this disclosure has excellent magnetic properties and mechanical strength.

The soft magnetic powder of this disclosure can be produced with good productivity using the method for manufacturing soft magnetic powder of this disclosure.

The magnetic core of this disclosure can be produced using the method for manufacturing a magnetic core of this disclosure.

The soft magnetic powder of this disclosure is soft magnetic powder constituted by an Fe alloy containing Si, in which soft magnetic particles in the soft magnetic powder include a $SiO_2$ layer formed on a surface of the particles, and a surface layer formed directly on the $SiO_2$ layer, the surface layer includes a first material that constitutes a matrix and a second material that is dispersed in the matrix, and the first material is silicone or phosphate, and the second material is silicone or phosphate and is different from the first material.

The magnetic core of this disclosure is a magnetic core constituted by a composite material containing soft magnetic powder and resin, in which the soft magnetic powder is the soft magnetic powder of this disclosure, a volume percentage of the soft magnetic powder in the composite material is 50% or more and 85% or less, and $B_s/\mu_m$ is 0.056 or more, where $B_s$ is a saturation flux density of the composite material and $\mu_m$ is a maximum magnetic permeability.

A method for manufacturing soft magnetic powder of this disclosure includes a preparation step of preparing base powder constituted by an Fe alloy containing Si; an annealing step of annealing the base powder at a temperature of 600° C. or more and 1000° C. or less for 0.5 hours or more and 3 hours or less; and a surface treating step of mixing a surface treatment agent into the annealed base powder in a warm atmosphere of 100° C. or less, in which the surface treatment agent is a mixture of a phosphoric acid solution and silicone.

A method for manufacturing a magnetic core of this disclosure includes a mixing step of mixing resin and the soft magnetic powder obtained using the method for manufacturing soft magnetic powder of this disclosure; and a molding step of molding a mixture obtained in the mixing step to a desired shape so as to obtain a magnetic core, in which the content of the soft magnetic powder in the mixture is 50 vol % or more and 85 vol % or less.

DETAILED DESCRIPTION OF PREFERRED EMBODIMENTS

Figure 1:
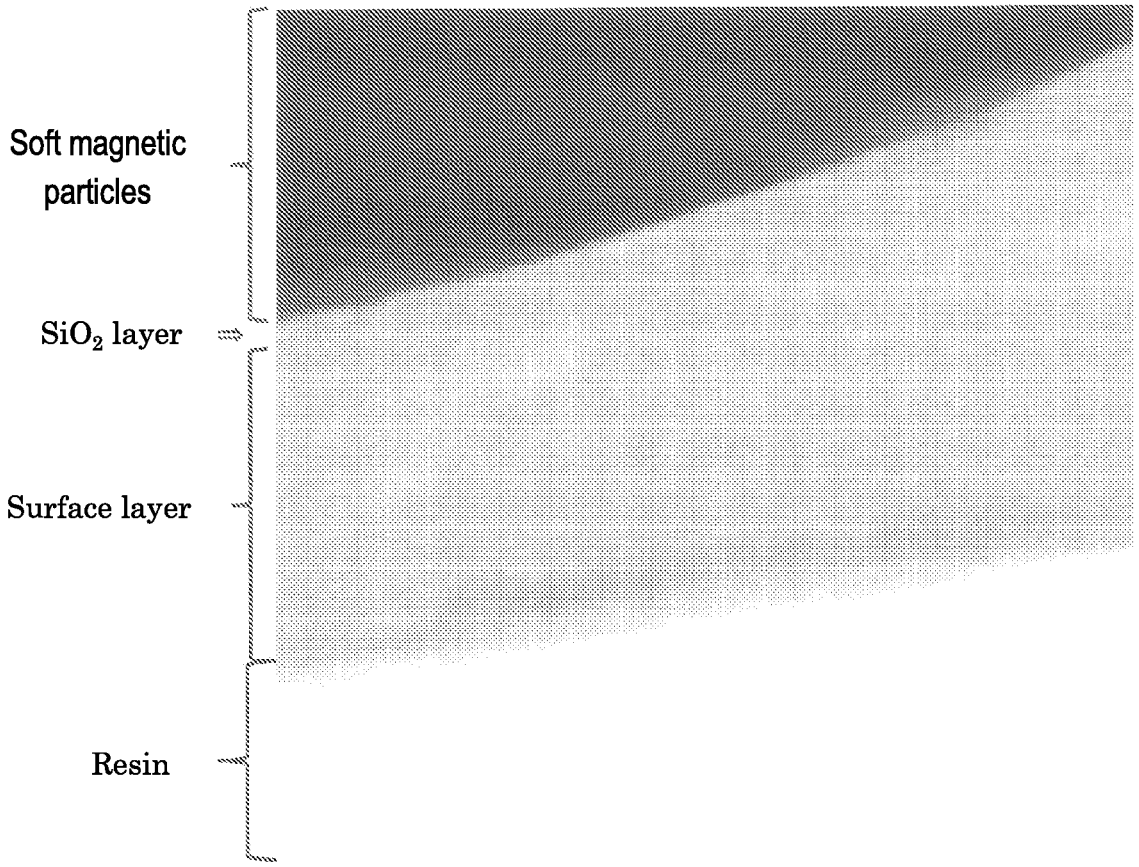
FIG. 1 is a diagram showing a transmission electron micrograph of soft magnetic particles that constitute soft magnetic powder according to an experimental example.

First, embodiments of this invention will be described.

The soft magnetic powder according to an embodiment is soft magnetic powder constituted by an Fe alloy containing Si, in which soft magnetic particles in the soft magnetic powder include a $SiO_2$ layer formed on a surface of the particles and a surface layer formed directly on the $SiO_2$ layer. The surface layer includes a first material that constitutes a matrix and a second material that is dispersed in the matrix, in which the first material is silicone or phosphate, and the second material is silicone or phosphate and is different from the first material.

The soft magnetic particles provided with the $SiO_2$ layer and the surface layer on their surface have good wettability with the resin. Thus, when the soft magnetic powder and the resin are mixed in production of the magnetic core (composite material), the soft magnetic powder is uniformly dispersed in the resin. As a result, the magnetic core produced using the soft magnetic powder according to the embodiment has a constant magnetic permeability according to which the relative magnetic permeability is maintained even in a high magnetic field.

The insulation of the above-described magnetic particles is ensured by the $SiO_2$ layer formed on their surface and the surface layer. Thus, if this soft magnetic powder is utilized to produce a magnetic core, it is possible to obtain a magnetic core with a low eddy current loss. Also, as shown in the method for manufacturing soft magnetic powder, which will be described later, the $SiO_2$ layer of the soft magnetic powder is formed through annealing, and thus distortion in the soft magnetic particles is eliminated. Thus, if this soft magnetic powder is utilized to produce a magnetic core, it is possible to obtain a magnetic core with low hysteresis loss. That is, utilizing the soft magnetic powder according to the embodiment makes it possible to produce a magnetic core with reduced iron loss.

Furthermore, if the above-described soft magnetic powder is utilized to produce a magnetic core, the magnetic core has excellent mechanical properties. This is because the soft magnetic powder uniformly disperses in the resin, and thus the magnetic core has a uniform overall strength. Also, the bonding strength between the soft magnetic particles and the resin being high due to the $SiO_2$ layer and the surface layer is also a factor for improving the mechanical strength of the magnetic core. Bending strength is a representative index for mechanical strength.

An aspect in which the first material is phosphate and the second material is silicone is one aspect of the soft magnetic powder according to the embodiment.

The phosphate has better adherence to $SiO_2$ than silicone. Thus, if the matrix of the surface layer is constituted by phosphate, it is possible to increase the adherence between the $SiO_2$ layer and the surface layer. As a result, the surface layer is unlikely to separate therefrom, and the occurrence of failure caused by separation of the surface layer can be suppressed. Examples of failure include a decrease in eddy current loss caused by contact between the soft magnetic particles and a decrease in the mechanical strength caused by a separated portion becoming a mechanical weak point.

An aspect in which an average thickness of the $SiO_2$ layer is 5 nm or more and 200 nm or less is one aspect of the soft magnetic powder according to the embodiment.

If the average thickness of the $SiO_2$ layer is 5 nm or more, the thickness of the surface layer can be made uniform when the surface layer is formed on the $SiO_2$ layer. As a result, it is possible to increase the insulation between the soft magnetic particles in the magnetic core and to increase bonding strength between the soft magnetic particles and the resin. Also, if the average thickness of the $SiO_2$ layer is 200 nm or less, it is possible to suppress cracks or separation of the $SiO_2$ layer when a magnetic core is manufactured by mixing the soft magnetic powder and the resin together.

An aspect in which the average thickness of the surface layer is 0.5 μm or more and 10 μm or less is one aspect of the soft magnetic powder according to the embodiment.

If the average thickness of the surface layer is 0.5 μm or more, it is possible to increase the insulation between soft magnetic particles in the magnetic core. Also, if the average thickness of the surface layer is 10 μm or less, a decrease in the magnetic properties and mechanical strength of the magnetic core caused by an excessively thick surface layer can be suppressed.

An aspect in which the Si content in the Fe alloy is 4.5 mass % or more and 8.0 mass % or less is one aspect of the soft magnetic powder according to the embodiment.

Setting the Si content in the above-described range makes it possible to reduce iron loss in the magnetic core using the soft magnetic powder according to the embodiment.

The magnetic core according to the embodiment is a magnetic core constituted by a composite material containing soft magnetic powder and resin, in which the soft magnetic powder is any of the soft magnetic powders according to 1 to 5 above, and a volume percentage of the soft magnetic powder in the composite material is 50% or more and 85% or less. In this magnetic core, $B_s/\mu m$ is 0.056 or more, where $B_s$ is a saturation flux density of the composite material and $\mu_m$ is a maximum magnetic permeability.

The above-described magnetic core has constant magnetic permeability and excellent mechanical strength with reduced iron loss. The reasons for this are as stated in the description of the soft magnetic powder in "1" above.

An aspect in which the resin is polyphenylene sulfide is one aspect of the magnetic core according to the embodiment.

Polyphenylene sulfide (PPS) can be easily obtained and has excellent moldability. On the other hand, polyphenylene sulfide does not have good wettability with Fe—Si alloy soft magnetic particles. However, in the magnetic core of this embodiment, a uniform surface layer is formed on the soft magnetic particles, and this surface layer has excellent wettability with PPS. Therefore, the advantages of PPS can be obtained without reducing the magnetic properties and mechanical properties of the magnetic core.

A method for manufacturing soft magnetic powder according to the embodiment includes a preparation step, an annealing step, and a surface treatment step.

In the preparation step, base powder constituted by an Fe alloy containing Si is prepared.

In the annealing step, the base powder is annealed at 600° C. or more and 1000° C. or less for 0.5 hours or more and 3 hours or less.

In the surface treatment step, a surface treatment agent is mixed into the annealed base powder in a warm atmosphere at 100° C. or less. The surface treatment agent is a mixture of a phosphoric acid solution and silicone.

With the method for manufacturing soft magnetic powder according to the embodiment, distortion of soft magnetic particles is removed by the annealing step, and a $SiO_2$ layer, which serves as an underlayer for uniformly forming a surface layer, is formed. Also, with the method for manufacturing soft magnetic powder according to the embodiment, a uniform surface layer is formed on the $SiO_2$ layer in the surface treatment step. As a result, soft magnetic powder according to the embodiment can be obtained. In this manner, the method for manufacturing soft magnetic powder according to the embodiment makes it possible to manufacture the soft magnetic powder according to the embodiment in simple processes with good productivity.

The method for manufacturing a magnetic core according to the embodiment includes a mixing step and a molding step.

In the mixing step, the soft magnetic powder obtained using the method for manufacturing soft magnetic powder and resin are mixed together. The content of the soft magnetic powder in the mixture is 50 vol % or more and 85 vol % or less.

In the molding step, a mixture obtained in the mixing step is molded to a desired shape so as to obtain a magnetic core.

According to the method for manufacturing a magnetic core, it is possible to manufacture the magnetic core according to the embodiment.

Magnetic Core

A magnetic core of the embodiment includes soft magnetic powder constituted by multiple soft magnetic particles and resin enveloping this soft magnetic powder in a dispersed state. This magnetic core meets the following requirements A to C.

A. A surface of the soft magnetic particles is provided with a $SiO_2$ layer formed by preliminarily annealing soft magnetic particles.

B. A surface layer is further provided directly on the $SiO_2$ layer of the soft magnetic particles.

C. The content of the soft magnetic powder (including the oxide film) in the magnetic core is 50 vol % or more and 85% or less.

Hereinafter, configurations of the magnetic core will be described in detail.

Soft Magnetic Powder

Soft Magnetic Particles

Soft magnetic particles constituting the soft magnetic powder are made of an Fe—Si alloy. In the Fe—Si alloy, Fe is the most abundant element, Si is the next abundant element, and the Si content is 4.5 mass % to 8.0 mass %. The Fe—Si alloy may contain additive elements other than Si as long as the content of the additive elements is less than the Si content. A more preferred Si content is 5 mass % or more and 7 mass % or less. The composition of the Fe—Si alloy can be obtained using Inductively Coupled Plasma Atomic Emission Spectroscopy (ICP-AES), for example.

An average particle size (D50; mass basis) of the soft magnetic powder (soft magnetic particles) is preferably 10 μm or more and 300 μm or less. Setting the average particle size of the soft magnetic particles to 10 μm or more makes it possible to avoid an excessive decrease in the flowability of the particles. Also, setting the average particle size to 300 μm or less makes it possible to effectively reduce the eddy current loss in the magnetic core. A more preferred average particle size of the soft magnetic particles is 45 μm or more and 250 μm or less.

There is no particular limitation on the shape of the soft magnetic particles. The soft magnetic particles may have a shape close to that of a perfect sphere, or a distorted shape. Soft magnetic particles obtained by gas atomization tend to have a shape close to that of a sphere, and soft magnetic particles obtained by water atomization tend to have a distorted shape.

$SiO_2$ Layer

The $SiO_2$ layer derived from Si included in the Fe—Si alloy is formed on the surface of the soft magnetic particles. This $SiO_2$ layer functions as an insulating film, is for forming a uniform surface layer thereon, and is a layer constituted substantially by Si and O (layer in which elements other than Si and O are impurities). The $SiO_2$ layer is distinguished from a natural oxide film. The natural oxide film contains a considerable amount of Fe. This $SiO_2$ layer is formed by annealing Fe—Si alloy soft magnetic particles (soft magnetic powder). The annealing conditions will be described later.

The average thickness of the above-described $SiO_2$ layer is preferably 5 nm or more and 200 nm or less. If the average thickness of the $SiO_2$ layer is 5 nm or more, it is possible to obtain the effect of being able to uniformly form the surface layer to be formed on the $SiO_2$ layer. Also, if the average thickness of the $SiO_2$ layer is 200 nm or less, it is possible to suppress cracks or separation of the $SiO_2$ layer when a magnetic core is manufactured by mixing the soft magnetic powder and the resin together. A more preferred average thickness of the $SiO_2$ layer is 10 nm or more and 50 nm or less.

The average thickness of the $SiO_2$ layer can be obtained from an image obtained using a Transmission Electron Microscope (TEM), for example. Specifically, ten or more soft magnetic particles are arbitrarily extracted from the TEM image, for example, and the thickness of the $SiO_2$ layer is measured at multiple (ten or more, for example) locations on the particles. The average value of the measurement values is regarded as the average thickness of the $SiO_2$ layer. A portion with a particularly large amount of Si in the TEM image is the $SiO_2$ layer. The average thickness of the $SiO_2$ layer can also be specified by Auger Electron Spectroscopy (AES). AES enables continuous measurement of the composition of soft magnetic particles in the vicinity of the $SiO_2$ layer in the film thickness direction, and the thickness of a portion constituted substantially by Si and O is obtained. This measurement is performed on multiple soft magnetic particles (N=10 or more, for example), and the measurement values are averaged. The average value thereof is regarded as the average thickness of the $SiO_2$ layer.

The content of the soft magnetic powder in the magnetic core is 50 vol % or more and 85 vol % or less. If the content of the soft magnetic powder is in this range, it is possible to obtain a magnetic core having desired magnetic properties. A more preferred content of the soft magnetic particles is 60 vol % or more and 80 vol % or less.

The content of the soft magnetic powder can be obtained by performing image analysis on the photograph of the cross section of the magnetic core. For example, the content of the soft magnetic particles can be obtained by obtaining the area ratio between soft magnetic particles and resin on the photograph of the cross section and regarding the obtained area ratio as the volume ratio. In this case, the higher the sampling number for the image analysis is, the more accurately the volume ratio can be obtained. For example, the above-described image analysis is performed in ten or more views, where a view including 50 or more soft magnetic particles is one view, and an average value of the area ratios in the views is regarded as the volume ratio. Moreover, the content of the soft magnetic powder can also be obtained by calculation based on the densities of the soft magnetic powder and the resin that constitute the soft magnetic material.

Surface Layer

The surface layer includes a first material that constitutes the matrix and a second material that is dispersed in the matrix. The first material is silicone or phosphate, and the second material is silicone or phosphate and is different from the first material. That is, the surface layer formed on the soft magnetic particles of this example is [1] a surface layer in which silicone is dispersed in the phosphate matrix, or [2] a surface layer in which phosphate is dispersed in the silicone matrix. The phosphate has better adherence to $SiO_2$ than silicone, and thus [1] the above-described surface layer is preferable.

It is thought that phosphate in the surface layer has a good affinity for the $SiO_2$ layer, and thus the adherence between the surface layer and the $SiO_2$ layer is increased. Also, it is thought that silicone in the surface layer has good wettability with resin, and thus the soft magnetic powder is easily dispersed in the resin when the soft magnetic powder is mixed with the resin and the adherence between the surface layer and the resin is increased after the resin is hardened.

The average thickness of the above-described surface layer is preferably 0.5 μm or more and 10 μm or less. If the average thickness of the surface layer is 0.5 μm or more, the wettability of soft magnetic particles with resin can be increased. Also, if the average thickness of the surface layer is 10 μm or less, it is possible to avoid a decrease in the magnetic properties of a magnetic core caused by an increase in the thickness of the surface layer. A more preferred average thickness of the surface layer is 1 μm or more and 5 μm or less. Similarly to the average thickness of the $SiO_2$ layer, the average thickness of the surface layer can be obtained using a TEM image or AES.

The state in which the second material is dispersed in the matrix (first material) in the surface layer can be checked using a TEM image. As shown in the TEM photograph in FIG. 1, which will be described later, portions in which the second material is dispersed in the form of islands in the matrix of the surface layer are formed in some cases.

Resin

A thermoplastic resin can be used as the resin that constitutes the magnetic core together with the soft magnetic powder. Examples thereof include polyphenylene sulfide (PPS) resins, polytetrafluoroethylene (PTFE) resins, liquid crystal polymers (LCPs), polyamide (PA) resins such as nylon 12 and polyamide 9T, polybutylene terephthalate (PBT) resins, and acrylonitrile butadiene styrene (ABS) resins. In particular, PPS resins are preferable because they are easily obtained and have excellent moldability.

Others

The resin may contain a ceramic filler such as alumina in addition to the soft magnetic powder. Doing so makes it possible to increase the heat dissipation of the magnetic core. The content of the ceramic filler in the magnetic core is preferably 0.1 vol % or more and 10 vol % or less.

Magnetic Properties of Magnetic Core

The magnetic core that contains the soft magnetic powder constituted by soft magnetic particles provided with the $SiO_2$ layer and the surface layer in an amount of 50 vol % or more and 85 vol % or less has a property according to which the relative magnetic permeability in a low magnetic field is also maintained in a high magnetic field (constant magnetic permeability). The constant magnetic permeability of the magnetic core can be evaluated based on $B_s/\mu_m$ being 0.056 or more, where $B_s$ is the saturation flux density of the composite material that constitutes the magnetic core, and $\mu_m$ is the maximum magnetic permeability. A more preferred $B_s/\mu_m$ value is 0.060 or more, and an even more preferred $B_s/\mu_m$ value is 0.062 or more. It is inferred that the constant magnetic permeability of the above-described magnetic core is a property that can be obtained in association with the fact that the soft magnetic powder is uniformly dispersed in the resin and soft magnetic particles have good wettability with the resin.

Mechanical Properties of Magnetic Core

Soft magnetic particles provided with a uniform surface layer have good wettability with resin. Thus, when the soft magnetic powder is mixed with the resin, the soft magnetic powder can be easily uniformly dispersed in the resin. That is, when the magnetic core is produced by molding the mixture of the soft magnetic powder and the resin, the soft magnetic powder is unlikely to be unevenly distributed in the magnetic core, and the magnetic core is unlikely to have mechanical weak points. In addition, the strength of bonding between the soft magnetic particles and the resin increases due to an increase in the wettability, and thus the magnetic core of the embodiment has excellent mechanical properties, compared to a conventional magnetic core. A representative mechanical property is bending strength. For example, the bending strength of the magnetic core preferably exceeds 70 MPa, and more preferably 80 MPa or more.

Method for Manufacturing Magnetic Core

The magnetic core according to the present embodiment can be manufactured using a method for manufacturing a magnetic core including a preparation step, an annealing step, a surface treatment step, a mixing step, and a molding step. Among these steps, the preparation step, the annealing step, and the surface treatment step are included in the soft magnetic powder manufacturing method for producing the soft magnetic powder according to the embodiment. Hereinafter, these steps will be described.

Preparation Step

The preparation step is a step of preparing base powder constituted by soft magnetic particles having no coating. As already described with items in the description of the soft magnetic powder, the soft magnetic particles are constituted by an Fe—Si alloy, and the Si content thereof is 4.5 mass % or more and 8.0 mass % or less.

Annealing Step

The annealing step is a step of annealing the base powder at a high temperature, and is the step for forming the $SiO_2$ layer on the surface of the soft magnetic particles. It is sufficient that the annealing conditions are set at a temperature of 600° C. or more and 1000° C. or less for 0.5 hours or more and 3 hours or less. These annealing conditions make it possible to remove distortion introduced in the soft magnetic particles when the soft magnetic particles are manufactured, and to efficiently form the $SiO_2$ layer with an appropriate thickness without performing unnecessary high-temperature and long-term processing. Distortion of the soft magnetic particles will cause hysteresis loss, and thus by removing the distortion, the iron loss in the magnetic core can be reduced. The thickness of the $SiO_2$ layer can be increased by increasing the temperature or the time period of annealing. The temperature and the time period of annealing may be determined depending on the average thickness of the $SiO_2$ layer.

Surface Treatment Step

The surface treatment step is a step of mixing a surface treatment agent into the annealed base powder in a warm atmosphere having a temperature of 100° C. or less, and is for forming a surface layer on the $SiO_2$ layer. The surface treatment agent is the mixture of a phosphoric acid solution and silicone. The mass ratio between the phosphoric acid solution and silicone (phosphoric acid solution:silicone) is preferably 1:1 to 1:0.25. As described above, the surface layer in which silicone is dispersed in the phosphate matrix is more preferable than the surface layer in which phosphate is dispersed in the silicone matrix in terms of the adherence to the $SiO_2$ layer. Thus, it is preferable to increase the ratio of the phosphoric acid solution in the surface treatment agent.

The amount of the mixed surface treatment agent can be selected as appropriate depending on the amount of the base powder or the thickness of the surface layer. For example, the surface treatment agent is mixed into the base powder at a mass ratio of about 0.5 or more and 5 or less when the base powder is set to 100. A general purpose mixture can be used to mix the base powder and the surface treatment agent.

The soft magnetic powder provided with the $SiO_2$ layer and the surface layer can be produced in the above-described preparation step, annealing step, and surface treatment step.

Mixing Step

The mixing step is a step of mixing the resin and the soft magnetic powder obtained through the surface treatment step together. The ratio between the soft magnetic powder and the resin can be regarded as being approximately equal to the ratio between the soft magnetic powder and the resin in the magnetic core to be produced. That is, the ratio at the time of mixing can be regarded as being maintained in the magnetic core. Also, the average particle size of soft magnetic particles can be regarded as being the same before and after mixing. That is, the average particle size of the soft magnetic particles prepared in the preparation step can be regarded as being approximately equal to the average particle size of soft magnetic particles in a magnetic core to be produced.

There is no particular limitation on the time for which the soft magnetic powder and the resin are mixed in the mixing step. The mixing time may be determined as appropriate with consideration given to the average particle size of the soft magnetic particles or the ratio of mixed soft magnetic powder and resin. Also, it is preferable to heat a mixing container during mixing in order not to reduce the flowability of the resin. The heating temperature is selected as appropriate depending on the temperature at which the resin is softened.

Molding Step

The molding step is a step of molding the mixture obtained in the mixing step to a desired shape. For example, the mixture is molded to a magnetic core through injection molding or the like. The pressure during molding can be selected as appropriate depending on the types of resin. Also, the magnetic core may be molded while the mold is heated.

Experimental Example 1

As the experimental examples, magnetic cores (Samples 1 to 8 below) were actually produced and their magnetic properties and mechanical properties were checked.

Sample 1

First, base powder constituted by soft magnetic particles was prepared (preparation step). The Si content in the soft magnetic particles was 6.5 mass % and the remaining portion was Fe and inevitable impurities, and an average particle size D50 of the soft magnetic particles was 80 μm. The base powder was annealed to form the $SiO_2$ layer on the surface of the soft magnetic particles (annealing step). Annealing temperature conditions were 900° C. for 2 hours in an atmosphere.

The above-described base powder was further subjected to surface treatment (surface treatment step). More specifically, a surface treatment agent obtained by mixing a phosphoric acid solution and silicone at a ratio (mass ratio) of 1:1 was prepared, the base powder was mixed with the surface treatment agent while the surface treatment agent was dripped on the base powder so as to complete the soft magnetic powder of Sample 1. The amount of the mixed surface treatment agent was such that the base powder:the surface treatment agent was a mass ratio of 100:3. Note that those conditions varied depending on the amount of the base powder or the like.

When the produced soft magnetic powder was observed through TEM, it was confirmed that the $SiO_2$ layer was formed on the surface of the soft magnetic particles, and the surface layer was formed on the $SiO_2$ layer. The TEM photograph of the soft magnetic particles is shown in FIG. 1. Si was present in the grey portions in FIG. 1. The black portions located near the top of FIG. 1 were soft magnetic particles, and the stripe-shaped portion with a particularly large amount of Si that was located at the center near the top was the $SiO_2$ layer. The surface layer in which Si was dispersed was formed below the $SiO_2$ layer. That is, it was confirmed that in the surface layer, Si was dispersed in the matrix constituted by the phosphate, that is, silicone was dispersed in the matrix. It was confirmed that with the soft magnetic powder that was produced in that experimental example, portions in the form of islands with a particularly large amount of silicone were formed in the surface layer. Also, the average thickness of the $SiO_2$ layers (n=10) that was obtained from the TEM photograph was 20 nm, and the average thickness of the surface layers (n=10) was 0.5 μm.

Next, the soft magnetic powder was mixed with resin (mixing step). The used resin was a PPS resin, and the volume ratio between the soft magnetic powder and the resin that were mixed together was 67:33. That is, the volume ratio of the soft magnetic powder to the mixture was 67 vol %. When the flowability of that mixture was measured, the flowability was 1680 g/10 min. This value increases as the wettability of soft magnetic particles with the resin increases, and the higher this value is, the more easily the magnetic core can be molded.

Lastly, the above-described mixture was subjected to injection molding so as to complete the magnetic core (Sample 1).

Sample 2

With Sample 2, a magnetic core was produced similarly to Sample 1, except that the mixing ratio between the soft magnetic powder and the resin was different. The volume ratio of the soft magnetic powder to the mixture of the soft magnetic powder and the resin was 70 vol %, and the melt flow rate of the mixture was 1173 g/10 min.

Sample 3

With Sample 3, a magnetic core was produced similarly to Sample 1, except that the mixing ratio between the soft magnetic powder and the resin was different. The volume ratio of the soft magnetic powder to the mixture of the soft magnetic powder and the resin was 72 vol %, and the melt flow rate of the mixture was 403 g/10 min.

Sample 4

With Sample 4, a magnetic core was produced using soft magnetic powder that was subjected to surface treatment without annealing the base powder that was prepared in the preparation step, that is, using soft magnetic powder constituted by soft magnetic particles having no $SiO_2$ layer. The production conditions for Sample 4 were the same as those for Sample 1, except that the soft magnetic particles contained no $SiO_2$ layer. That is, a surface layer was formed directly on the soft magnetic particles in Sample 4. The melt flow rate of the mixture in which the content of the soft magnetic powder was 67 vol % was 1338 g/10 min.

Sample 5

With Sample 5, a magnetic core was produced similarly to Sample 4, except that the mixing ratio between the soft magnetic powder and the resin was different. The volume ratio of the soft magnetic powder to the mixture according to the production of Sample 5 was 70 vol %, and the melt flow rate of the mixture was 887 g/10 min.

Sample 6

With Sample 6, a magnetic core was produced similarly to Sample 4, except that the mixing ratio between the soft magnetic powder and the resin was different. However, the magnetic core was not molded because the mixture according to the production of Sample 6 had excessively low flowability. The volume ratio of the soft magnetic powder to the mixture was 72 vol %, and the melt flow rate of the mixture was 293 g/10 min.

Sample 7

The magnetic core of Sample 7 was produced using soft magnetic powder that was obtained by forming a $SiO_2$ layer on the surface of soft magnetic particles similarly to Sample 1 and then forming a silicone layer on the $SiO_2$ layer. An average thickness of the silicone layer was adjusted so as to be approximately equal to the average thickness of the surface layers of Samples 1 to 6. The volume ratio of the soft magnetic powder to the mixture according to the production of Sample 7 was 70 vol %, and the melt flow rate of the mixture was 1000 g/10 min.

Sample 8

The magnetic core of Sample 8 was produced using soft magnetic powder that was obtained by forming a $SiO_2$ layer on the surface of soft magnetic particles similarly to Sample 1 and then forming a phosphate layer on the $SiO_2$ layer. An average thickness of the phosphate layer was adjusted so as to be approximately equal to the average thickness of the surface layers of Samples 1 to 6. The volume ratio of the soft magnetic powder to the mixture according to the production of Sample 8 was 70 vol %, and the melt flow rate of the mixture was 1100 g/10 min.

Measurement of Properties

Magnetic properties (saturation flux density, relative magnetic permeability, and eddy current loss) and bending properties of the magnetic cores of Samples 1 to 8 were measured. The composition of each sample and the measurement results are shown in Table 1. The measurement methods are as follows.

In the evaluation of the magnetic properties, a test member with a primary winding having 300 turns and a secondary winding having 20 turns was used in a ring-shaped magnetic core having an inner diameter of 20 mm, an outer diameter of 34 mm, and a thickness of 5 mm. The saturation flux density ($B_s$), the maximum magnetic permeability ($\mu_m$), and an eddy current loss We1/20 k at an excitation magnetic flux density Bm of 1 kG (=0.1 T) and a measurement frequency of 20 kHz of the test member were measured using a BH curve tracer (DCBH tracer manufactured by Riken Denshi Co., Ltd.). Here, $B_s/\mu_m$ being 0.056 or more served as one of the indices for determining that the magnetic core had excellent constant magnetic permeability.

A rod-shaped test piece having a size of 77 mm×13 mm×3.2 mm was used to evaluate bending properties. The bending strength (MPa) of the rod-shaped test piece was measured by performing a three-point bending test using a commercially-available bending test apparatus. The support span was 50 mm, and the test speed was 5 mm/min in the bending test.

TABLE 1

| Sample | Soft magnetic powder | | Magnetic powder filling ratio | | MFR | Saturation flux density $B_s$ | Max. magnetic permeability | | Eddy current loss (We1/20k) | Bending strength |
|---|---|---|---|---|---|---|---|---|---|---|
| No. | composition | layer structure | vol % | Resin | g/10 min | T | $\mu_m$ | $B_s/\mu_m$ | kW/m$^3$ | MPa |
| 1 | Fe—6.5Si | $SiO_2$/surface layer | 67 | PPS | 1680 | 1.15 | 18.5 | 0.062 | 30 | 80 |
| 2 | Fe—6.5Si | $SiO_2$/surface layer | 70 | PPS | 1173 | 1.22 | 20.5 | 0.060 | 32 | 80 |
| 3 | Fe—6.5Si | $SiO_2$/surface layer | 72 | PPS | 403 | 1.26 | 22.5 | 0.057 | 38 | 80 |
| 4 | Fe—6.5Si | only surface layer | 67 | PPS | 1338 | 1.15 | 21.0 | 0.055 | 39 | 68 |
| 5 | Fe—6.5Si | only surface layer | 70 | PPS | 887 | 1.21 | 22.5 | 0.054 | 42 | 70 |
| 6 | Fe—6.5Si | only surface layer | 72 | PPS | 293 | material had poor flowability, and thus molding was impossible (measurement was impossible) | | | | |
| 7 | Fe—6.5Si | $SiO_2$/silicone | 70 | PPS | 1000 | 1.22 | 21 | 0.060 | 30 | 60 |
| 8 | Fe—6.5Si | $SiO_2$/phosphate | 70 | PPS | 1100 | 1.22 | 20 | 0.061 | 32 | 68 |

As shown in the test results in Table 1, $B_s/\mu_m$ of Samples 1 to 3 using the soft magnetic powder provided both the $SiO_2$ layer and the surface layer was 0.056 or more, the eddy current loss was 38 kW/m$^3$ or less, and the bending strength was 80 MPa or more. In contrast, $B_s/\mu m$ of Samples 4 and 5 using the soft magnetic powder provided with only the surface layer was less than 0.056, the eddy current loss was 39 kW/m$^3$ or more, and the bending strength was 70 MPa or less. Furthermore, Sample 7 in which the silicone layer was formed on the $SiO_2$ layer and Sample 8 in which the phosphate layer was formed on the $SiO_2$ layer had excellent magnetic properties but had low bending strength.

In Samples 1 to 3 above, the surface layer was uniformly formed due to the $SiO_2$ layer that was formed on the surface of the soft magnetic particles. The uniformly formed surface layer suppressed contact between soft magnetic particles and improved the wettability between soft magnetic particles and resin. It is inferred that as a result, the magnetic properties of Samples 1 to 3 improved.

Also, the bending strength of Samples 1 to 3 was significantly higher than the bending strength of Samples 4, 5, 7, and 8. It is inferred that the reason for that was the soft magnetic powder being uniformly dispersed in the magnetic cores of Samples 1 to 3, and thus few bending weak points were present, and the resin and the surface layer of the soft magnetic particles were in close contact with each other.

Application Examples of Magnetic Core

Figure 2:
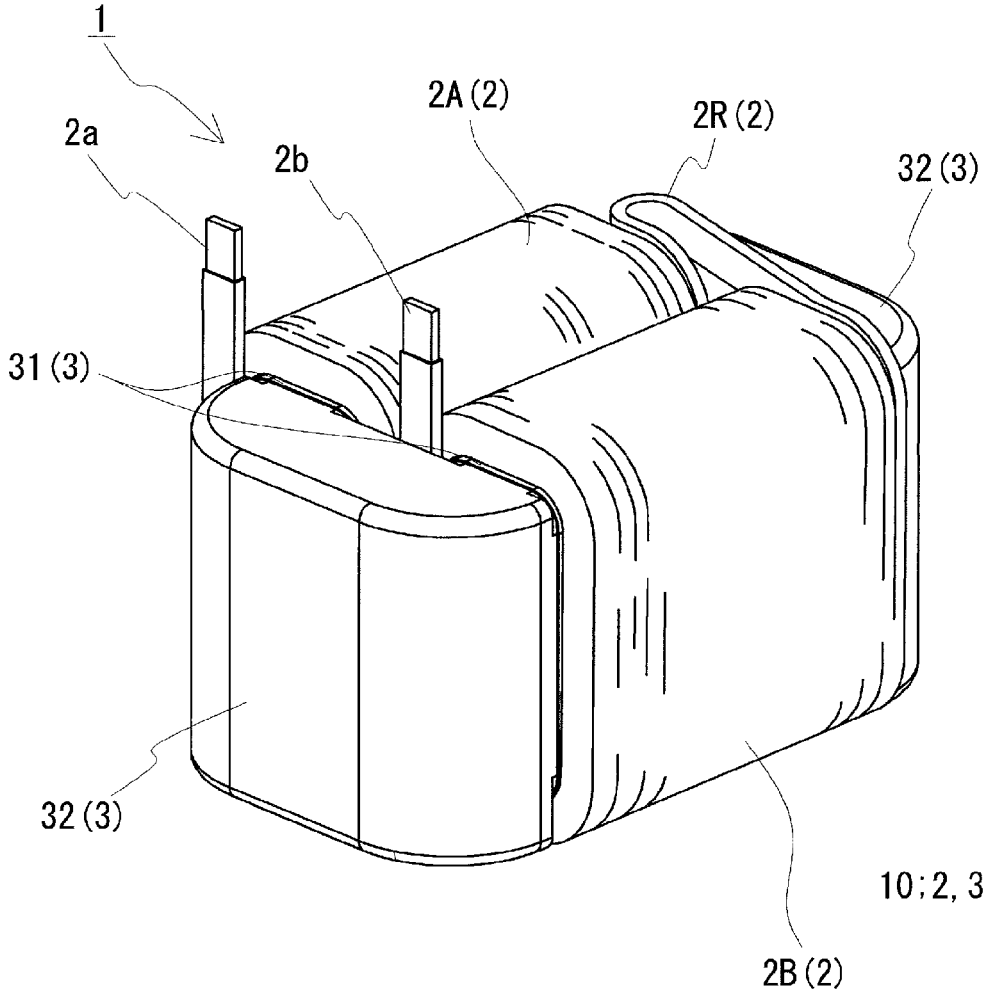
FIG. 2 is a schematic perspective view of a reactor in embodiments.

Next, an example in which the magnetic core of this embodiment is applied to a reactor will be described with reference to FIG. 2. FIG. 2 is a schematic perspective view of a reactor 1. Note that the reactor 1 shown in FIG. 2 and the shape of the constituent members are merely examples, and the present invention is not limited to this shape.

Overall Configuration of Reactor

The reactor 1 shown in FIG. 2 is an assembly 10 of a coil 2 and a magnetic core 3. The assembly 10 is joined onto a heat dissipation plate (not shown) via a joint layer. The reactor 1 may have a configuration including a case for accommodating the assembly 10, and in this case, the bottom surface of the case functions as the heat dissipation plate. The coil 2 of this reactor 1 has a pair of winding portions 2A and 2B, and the magnetic core 3 includes a pair of inner core portions 31 and 31 and a pair of outer core portions 32 and 32.

Coil

The coil 2 includes a pair of winding portions 2A and 2B, and a connection portion 2R for linking the winding portions 2A and 2B. The coil 2 is preferably constituted by a covered wire including an insulating coating made of an insulating material on the outer circumference of a conductor such as a flat wire or a round wire made of a conductive material such as copper, aluminum, or an alloy thereof.

Two ends 2*a* and 2*b* of the coil 2 respectively extend from turn formation portions, and are connected to a terminal member (not shown). An external apparatus (not shown) such as a power source for supplying power to the coil 2 is connected via this terminal member.

Magnetic Core

The magnetic core 3 includes the pair of inner core portions 31 and 31 that are arranged inside the winding portions 2A and 2B, and the pair of outer core portions 32 and 32 that are exposed from the winding portions 2A and 2B and sandwich the inner core portions 31 and 31 from both sides. At least a part of these inner core portions 31 and outer core portions 32 can be constituted by the magnetic core described in the embodiment.

Application of Reactor

The reactor 1 having the above-described configuration can be suitably utilized in applications whose power supply conditions are such that the maximum electric current (direct current) is about 10 A to 1000 A, the average voltage is about 100 V to 1000 V, and the use frequency is about 5 kHz to 100 kHz, and the reactor 1 is typically utilized as a constituent part of an in-vehicle power conversion device in an electric car or a hybrid car.

The invention claimed is:

1. A magnetic core constituted by a composite material containing soft magnetic powder and resin, wherein the soft magnetic powder is constituted by an Fe alloy containing Si, wherein soft magnetic particles of the soft magnetic powder include a $SiO_2$ layer formed on a surface of the particles, and a surface layer formed directly on the $SiO_2$ layer, the surface layer includes a first material that constitutes a matrix and a second material that is dispersed in the matrix, and the first material is silicone or phosphate, and the second material is silicone or phosphate and is different from the first material;

wherein a volume percentage of the soft magnetic powder in the composite material is 50% or more and 85% or less, and $B_s/\mu_m$ is 0.056 or more, where $B_s$ is a saturation flux density of the composite material and $\mu_m$ is a maximum magnetic permeability.

2. The magnetic core according to claim 1, wherein the resin is polyphenylene sulfide.

3. The magnetic core according to claim 1, wherein an average thickness of the $SiO_2$ layer is 5 nm or more and 200 nm or less.

4. The magnetic core according claim 1, wherein an average thickness of the surface layer is 0.5 μm or more and 10 μm or less.

5. The magnetic core according claim 2, wherein an average thickness of the surface layer is 0.5 μm or more and 10 μm or less.

6. The magnetic core according to claim 1, wherein the Si content in the Fe alloy is 4.5 mass % or more and 8.0 mass % or less.

7. The magnetic core according to claim 2, wherein the Si content in the Fe alloy is 4.5 mass % or more and 8.0 mass % or less.

8. The magnetic core according to claim 5, wherein the Si content in the Fe alloy is 4.5 mass % or more and 8.0 mass % or less.

9. A magnetic core constituted by a composite material containing soft magnetic powder and resin, wherein the soft magnetic powder is constituted by an Fe alloy containing Si, wherein soft magnetic particles of the soft magnetic powder include a $SiO_2$ layer formed on a surface of the particles, and a surface layer formed directly on the $SiO_2$ layer, the surface layer includes a first material that constitutes a matrix and a second material that is dispersed in the matrix, and the first material is phosphate, and the second material is silicone, a volume percentage of the soft magnetic powder in the composite material is 50% or more and 85% or less, and $B_s/\mu_m$ is 0.056 or more, where $B_s$ is a saturation flux density of the composite material and $\mu_m$ is a maximum magnetic permeability.

10. A magnetic core constituted by a composite material containing soft magnetic powder and resin, wherein the soft magnetic powder is constituted by an Fe alloy containing Si, wherein soft magnetic particles of the soft magnetic powder include a $SiO_2$ layer formed on a surface of the particles, and a surface layer formed directly on the $SiO_2$ layer, the surface layer includes a first material that constitutes a matrix and a second material that is dispersed in the matrix, and the first material is silicone or phosphate, and the second material is silicone or phosphate and is different from the first material, wherein an average thickness of the $SiO_2$ layer is 5 nm or more and 200 nm or less;

a volume percentage of the soft magnetic powder in the composite material is 50% or more and 85% or less, and $B_s/\mu_m$ is 0.056 or more, where $B_s$ is a saturation flux density of the composite material and $\mu_m$ is a maximum magnetic permeability.

11. A magnetic core constituted by a composite material containing soft magnetic powder and resin, wherein the soft magnetic powder is constituted by an Fe alloy containing Si, wherein soft magnetic particles of the soft magnetic powder include a $SiO_2$ layer formed on a surface of the particles, and a surface layer formed directly on the $SiO_2$ layer, the surface layer includes a first material that constitutes a matrix and a second material that is dispersed in the matrix, and the first material is silicone or phosphate, and the second material is silicone or phosphate and is different from the first material, wherein an average thickness of the surface layer is 0.5 μm or more and 10 μm or less, a volume percentage of the soft magnetic powder in the composite material is 50% or more and 85% or less, and $B_s/\mu_m$ is 0.056 or more, where $B_s$ is a saturation flux density of the composite material and $\mu_m$ is a maximum magnetic permeability.

12. A magnetic core constituted by a composite material containing soft magnetic powder and resin, wherein the soft magnetic powder is constituted by an Fe alloy containing Si, wherein soft magnetic particles of the soft magnetic powder include a $SiO_2$ layer formed on a surface of the particles, and a surface layer formed directly on the $SiO_2$ layer, the surface layer includes a first material that constitutes a matrix and a second material that is dispersed in the matrix, and the first material is silicone or phosphate, and the second material is silicone or phosphate and is different from the first material, wherein an average thickness of the surface layer is 0.5 μm or more and 10 μm or less, wherein the Si content in the Fe alloy is 4.5 mass % or more and 8.0 mass % or less, a volume percentage of the soft magnetic powder in the composite material is 50% or more and 85% or less, and $B_s/\mu_m$ is 0.056 or more, where $B_s$ is a saturation flux density of the composite material and $\mu_m$ is a maximum magnetic permeability.

* * * * *